US005513790A

United States Patent [19]

Giusto

[11] Patent Number: 5,513,790

[45] Date of Patent: May 7, 1996

[54] FACE SEALING AIR ACTUATED VALVE IN AN INTERMITTENT FEED DEVICE

[76] Inventor: Placido Giusto, Corso Moncalieri, 72 - 10133 Torino, Italy

[21] Appl. No.: 159,261

[22] Filed: Nov. 30, 1993

[51] Int. Cl.[6] ..... B65H 20/00

[52] U.S. Cl. ..... 226/150; 137/625.66

[58] Field of Search ..... 226/150, 149, 226/158, 167; 137/625.66, 625.27, 625.26

[56] References Cited

U.S. PATENT DOCUMENTS

| | | | |
|---|---|---|---|
| 3,937,379 | 2/1976 | Narwid et al. | 226/150 |
| 4,051,802 | 10/1977 | Haytayan | 137/454.2 |
| 4,823,840 | 4/1989 | Kosugi et al. | 137/625.27 |
| 5,062,349 | 11/1991 | Khan | 91/436 |

FOREIGN PATENT DOCUMENTS

| | | | |
|---|---|---|---|
| 1189346 | 3/1965 | Germany | 137/625.27 |

*Primary Examiner*—Daniel P. Stodola
*Attorney, Agent, or Firm*—Sughrue, Mion, Zinn, Macpeak & Seas

[57] ABSTRACT

A feeding device for web material has a pneumatic actuator assembly incorporating a three-way pneumatically piloted control valve which controls communication between the pneumatic actuator assembly and a source of air under pressure and a discharge port, respectively. The control valve includes a spool having a plunger disposed in a first chamber connected to a pilot passage, a cylindrical obturator located in a second passage having an air inlet passage located in an end of the chamber surrounded by a flat face seal seat and a radial air outlet passage leading to the feeding device. An intermediate chamber is disposed in communication with the second chamber and is connected to a discharge passage. A flat annular face seal seat is formed between the second chamber and the intermediate chamber whereby the two flat face seal seats are engageable by flat opposite faces of the cylindrical obturator.

1 Claim, 2 Drawing Sheets

FIG.1 PRIOR ART
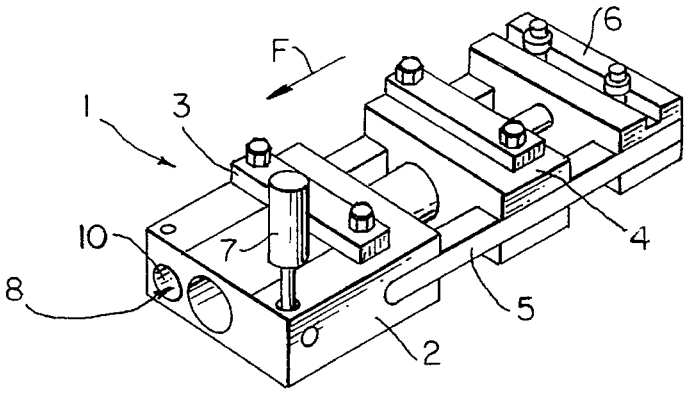
FIG.2 PRIOR ART
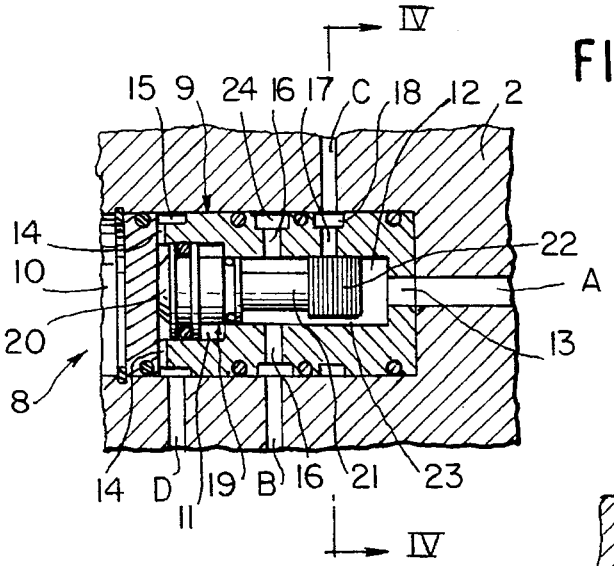
FIG.3 PRIOR ART
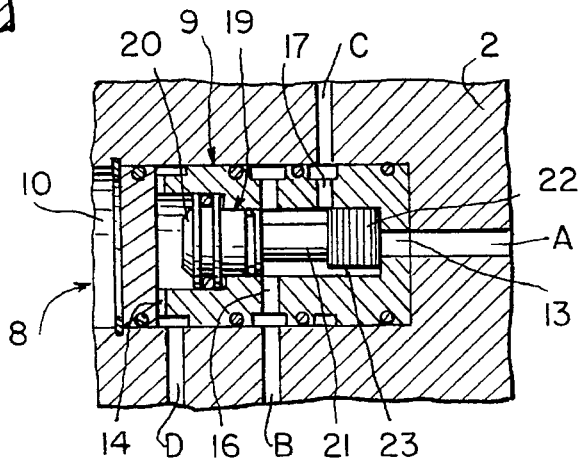
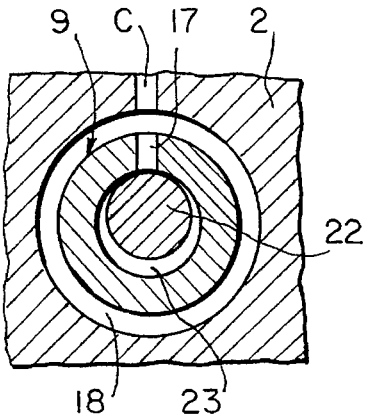
FIG.4 PRIOR ART

FACE SEALING AIR ACTUATED VALVE IN AN INTERMITTENT FEED DEVICE

BACKGROUND OF THE INVENTION

The present invention is generally related to feeding of webs of any material towards a work station, particularly but not exclusively to a forming press. More particularly, the invention is directed to a feeding device for web material, of the type comprising step-feed means of the web along a longitudinal direction comprising a stationary gripper and a movable gripper, a pneumatic actuator assembly for operating linear alternative forward and back displacement of the movable gripper relative to the stationary gripper parallelly to said longitudinal direction and opening and closure of said grippers in synchronism with the alternative displacement of the movable gripper, and an adjustable stop member cooperating with the movable gripper at the end of the forward displacement thereof. In such feeding devices the pneumatic actuator assembly traditionally comprises a block incorporating a three-way pneumatically piloted control valve, which controls the communication between said pneumatic actuator assembly and, respectively, a source of air under pressure and a discharge port.

Feeding devices of the above mentioned type are currently manufactured and marketed for instance by ELMER of Turin, Italy. In these known feeding devices, the control valve traditionally comprises a hollow body having an inlet axial passage communicating with a feeding line from said pressurised air source, a radial inlet passage communicating with a pneumatic piloting line, a first and a second radial outlet passages respectively communicating with the pneumatic actuator assembly and with the discharge, and a spool having at one end thereof a plunger subject to the pressure from the piloting line, and having at the other end thereof a floating obturator which, in presence of the piloting pressure, face-sealingly closes said inlet axial passage and opens the communication between the first and the second radial outlet passages, and in the absence of the piloting pressure closes the second radial outlet passage and opens the communication between the inlet axial passage and the first radial outlet passage. In other words, in presence of piloting pressure the pneumatic actuator assembly controlled by the valve is connected to the discharge, while in the absence of piloting pressure the pneumatic actuator assembly is connected to the source of air under pressure.

A feeding device for web material according to the prior art, provided with such a control valve, is shown in FIGS. 1 through 4 of the drawings.

In FIG. 1, reference numeral 1 generally designates a feeding device for web material according to the prior art, which is intended to be combined with a support and guide system of a web, known per se and not shown in the drawings.

The feeding device 1 comprises, a block 2 carrying a stationary gripper 3, a movable gripper 4 displaceable along guides 5 according to a linear alternative motion parallelly to a longitudinal feed direction F of the web, and an adjustable stop member 6 cooperating with the movable gripper 4 at the end of the forward displacement thereof.

Displacement of the movable gripper 4 and opening and closure of the stationary gripper 3 and the movable gripper 4 are operated by means of a pneumatic actuator assembly, not shown in the drawings for the sake of brevity, which is incorporated within the block 2 and is in turn controlled by means of an actuating valve device 7, directly operated mechanically, for instance by the forming press to which the feeding device 1 may be in use associated, or by a pneumatic or electropneumatic remote control, in a way known per se.

The pneumatic actuator assembly incorporated in the block 2 includes a three-way control valve 8, named as "secondary valve", controlling the communication between the pneumatic actuator assembly and, respectively, an external source of pressurised air (not shown) and a discharge port.

Referring now in more detail to FIGS. 2 and 4, the control valve 8 according to the prior art comprises a hollow valve body 9 housed within a rear cylindrical seat 10 of the block 2 and defining a first chamber 11 and a second elongated chamber 12, coaxial to each other. The first chamber 12 is connected, at the end thereof opposite to the first chamber 11, with an axial inlet passage 13 formed through the valve body 9 and communicating with a feed line A, formed within the block 2 and connected to the source of air under pressure.

The first chamber 11 is connected, in correspondence of the end thereof opposite to the second chamber 12, with one or more radial inlet passages 14 communicating, through an annular chamber 15 formed in the valve body 9, with a pneumatic piloting line D formed within the block 2, and in turn controlled by means of the control valve 7.

The chamber 12 is further connected, on the side of the chamber 11, with one or more radial passages 16 communicating with an annular chamber 24 formed in the valve body 9 and in turn communicating with a feed line B to the pneumatic actuator group, formed within the body 2. On the side of the axial passage 13, the chamber 12 is connected through a single radial passage 17 and an annular chamber 18 formed in the valve body 9, with a discharge line C also formed within the block 2.

Reference 19 designates a spool which is axially movable within the hollow valve body 9, and which is formed at one end thereof with a plunger 20 sealingly slidable along the first chamber 11, and at the other end with a stem 21 extending coaxially into the second chamber 12. An obturator 22, floating within the chamber 12, is adjacent to the stem 21.

The obturator 22 has a cylindrical shape with a cross section which is smaller than that of the chamber 12, so as to define with the wall of the latter an axial passage 23, as explained below.

Operation of the known control valve 8 is as follows. In the absence of the piloting pressure in the piloting line D, the spool 19 is maintained in the position depicted in FIG. 2, in which it is shifted to the left with reference to the drawing. In this condition, due to the pressure difference between the chamber 12 and the discharge line C, the lateral surface of the obturator 22 is on one side maintained in contact with the area of the wall of the chamber 12 in correspondence of which the discharge passage 17 opens, while on the other side it defines with the wall of the chamber 12 the axial passage 23.

The radial discharge passage 17 is thus closed, while communication between the axial feed passage 13 and the radial outlet passages 16 is open through the axial passage 23, whereby the air under pressure from the feed line A is fed through the line B to the pneumatic actuator assembly, so as to perform the operating functions of the web feeding device 1.

In presence of the piloting pressure in the line D, the spool 19 is instead placed in the position shown in FIG. 3, in which it is shifted on the right with reference to the drawing, whereby the obturator 22 face-sealingly closes the axial feed passage 13, while opening the communication between the radial passages 16 and 17, i.e. between the line B connected to the pneumatic actuator assembly and the discharge line C. This known construction, while being extremely simple from the point of view of manufacturing, is subject to a functional limit related to the possibility of increasing the air rate of flow from the feed line A to the line B connected to the pneumatic actuator group, to the aim of enhancing the operative functionality of the feed device 1. In fact, in order to increase the air rate of flow, it is necessary to reduce the diameter of the obturator 22, so as to increase the size of the passage 23. However, beyond a certain ratio between the diameter of the obturator 22 and the diameter of the chamber 12, the lateral wall of this obturator 22 is no more able to adhere with a sufficient seal onto the corresponding area of the wall of the chamber 12 and, consequently, in the absence of piloting pressure it is not possible to obtain an airtight closure of the radial discharge passage 17.

SUMMARY OF THE INVENTION

The object of the present invention is to overcome the above mentioned drawback, and to provide a web material feeding device of the type set forth at the beginning, the control valve of which enables, while maintaining a simple and cheap construction, an appreciable increase of the rate of flow of the air fed to the pneumatic actuator assembly, ensuring at the same time a perfect airtight closure of the discharge passage in the corresponding condition of use, i.e. in the absence of the piloting pressure.

According to the invention, this object is achieved by virtue of the fact that the valve body valve and the obturator are formed with respective flat face seal surfaces for the closure, in the absence of the piloting pressure, of said second outlet passage.

The invention will now be disclosed in detail with reference to FIGS. 5 and 6 of the annexed drawings, which show diagrammatically in axial section the control valve of the feeding device according to the invention, in two different operating conditions.

The foregoing and other objects, features and advantages of the invention will be apparent form the following more detailed description of the present invention as illustrated in the accompanying drawings.

BRIEF DESCRIPTION OF THE DRAWINGS

FIG. 1 is a perspective view of a prior art feeding device.

FIG. 2 is a longitudinal sectional view of the control valve of the prior art feeding device in a first operating condition.

FIG. 3 is a view similar to FIG. 2 showing the control valve in a second operation condition.

FIG. 4 is a sectional view taken along the line IV—IV in FIG. 2.

In FIGS. 5 and 6 parts identical or similar to those previously described with reference to the prior art are indicated with the same reference numerals. According to the invention, the cavity of the valve body 9 of the control valve 8 is formed, starting from the chamber 11 communicating with the piloting line D through the radial passages 14 and the annular chamber 15, with a restricted section 25 for guiding the stem 21, followed by an intermediate chamber 26 and by a second enlarged chamber 27.

Figure 5:
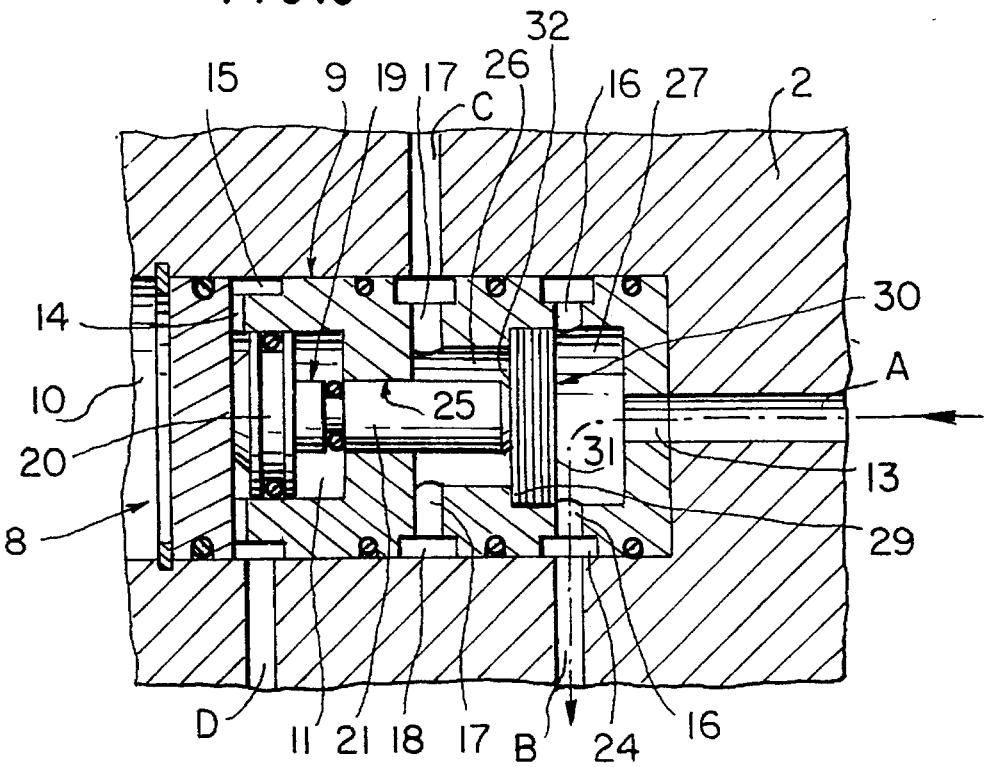
FIG. 5 is a longitudinal sectional view of the control valve of the present invention in a first operation condition.

The intermediate chamber 26 communicates, through a series of radial passages 17 and the annular chamber 18, with the discharge line C.

The second chamber 27, axially connected with the inlet passage 13 communicating with the feed line A, is connected in correspondence of a central area thereof, with the radial passages 16 and with the annular chamber 24 communicating with the line B connected to the pneumatic actuator assembly.

Between the intermediate chamber 26 and the second chamber 27, the valve body 9 defines an a flat annular face seal seat 29.

The valve obturator is constituted by a floating disk element 30 having a cylindrical shape, or a frusto-conical shape with the smaller end facing towards the inlet axial passage 13, which is coaxial with the stem 21 and whose lateral wall is in circumferential sliding contact with the wall of the second chamber 27. Moreover, in the shown example the axial dimension of the obturator 30 is substantially corresponding to the distance between the radial passages 16 and the flat annular face seal seat 29, on one side, and between the passages 16 and the bottom of the second chamber 27 connected to the axial inlet passage 13, on the other side.

The face of the obturator 30 facing towards the feed passage A defines a first face seal surface 31, and its opposite face, i.e. that facing towards the intermediate chamber 26, defines a second face seal surface 32 adapted to cooperate with the flat annular face seal seat 29.

In operation, in the absence of piloting pressure from the piloting line D the spool 19 is positioned such as depicted in FIG. 5, i.e. is shifted to the left with reference to the drawings. In this condition the obturator 30 is maintained with the second face seal surface 32 into airtight contact against the flat annular face seal seat 29, whereby the communication between the feed line A and the line B connected to the pneumatic actuator assembly is open, while the communication between this line B and the discharge line C is closed.

Figure 6:
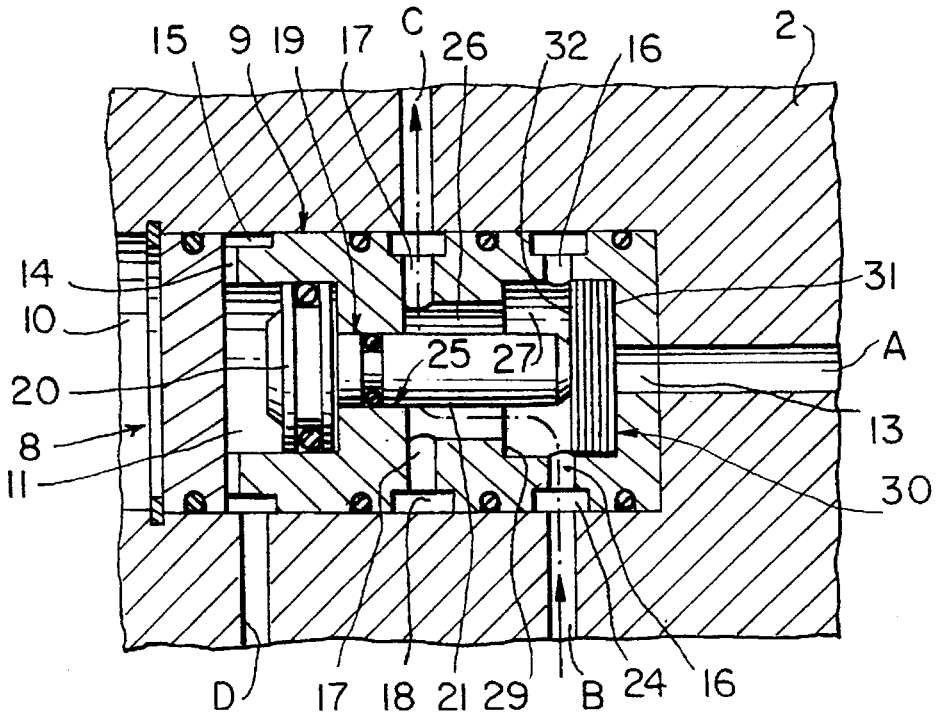
FIG. 6 is a view similar to FIG. 5 showing the control valve in a second operation condition.

In presence of the piloting pressure, the spool 19 is placed in the position shown in FIG. 6, i.e. is shifted to the right with reference to the drawings. In this condition the first flat face seal surface 31 of the obturator 30 is maintained into airtight contact against the flat bottom surface of the chamber 27, thus interrupting the communication with the feed passage A, while the line B of the pneumatic actuator assembly is in communication, through the intermediate chamber 26, with the discharge line C.

It will be apparent from the foregoing that the disposition according to the invention of the control valve 8 enables a substantial increase of the rate of flow of the air fed by the feed line A to the line B connected to the pneumatic actuator assembly, without negatively affecting airtight closure of the discharge line C, in presence of the piloting pressure. On the contrary, any increase of the air rate of flow increases the sealing thrust of the flat face seal surface 32 of the obturator 30 against the corresponding flat annular face seal seat 29.

What I claim is:

1. A feed device for feeding a web material to a work station comprising step-feed means for feeding the web material along a longitudinal direction comprising a stationary gripper and a movable gripper, a pneumatic actuator assembly for operating linear alternative forward and back displacement of the movable gripper relative to the stationary gripper parallel to said longitudinal direction and opening and closing said grippers in synchronism with the alternative displacement of the movable gripper, and an adjustable stop member cooperating with the movable gripper at the end of the forward displacement thereof, wherein said pneumatic actuator assembly comprises a block incorporating a three-way pneumatically piloted control valve for controlling communication between said pneumatic actuator assembly and, respectively, a feedline adapted to be connected to a source of air under pressure and a discharge, said control valve comprising a hollow valve body having an axial inlet passage in communication with said feed line, a radial inlet passage in communication with a pneumatic piloting line, and a first and a second radial outlet passages communicating respectively with the pneumatic actuator assembly and with the discharge, and a spool having at one end thereof a plunger subject to the pressure from the piloting line and at the other end thereof a floating obturator which, in presence of the piloting pressure, face sealingly closes said axial inlet passage and opens the communication between the first and the second radial outlet passages, and in the absence of the piloting pressure closes the second radial outlet passage and opens the communication between the axial inlet passage and the first radial outlet passage, and wherein the valve body and the obturator of the control valve are formed with respective flat face seal surfaces for the closure, in the absence of the piloting pressure, of said second outlet passage, wherein:

the hollow valve body of the control valve has a first chamber in which said plunger of the spool is sealingly slidable axially, a second chamber in which said floating obturator is axially movable, and an intermediate cavity between said first and second chambers, the first chamber being connected with the radial inlet passage, the second chamber being connected with the axial inlet passage and with the first radial outlet passage, and the intermediate cavity being connected with the second radial outlet passage such that a flat annular face seal seat is defined between the second chamber and the intermediate cavity, the floating obturator is constituted by a disk element having a first flat face facing towards the axial inlet passage and defining a first flat face seal surface adapted to sealingly engage a flat bottom surface in said second chamber surrounding said axial inlet passage, and a second flat face facing towards the intermediate cavity and defining a second flat face seal surface adapted to cooperate with said flat annular face seal seat in the absence of the piloting pressure.

* * * * *